US005507096A

United States Patent [19]

Gamba

[11] Patent Number: 5,507,096

[45] Date of Patent: Apr. 16, 1996

[54] FLUSHCUTTER

[76] Inventor: Gregory G. Gamba, 4 Locust Pl., Livingston, N.J. 07039

[21] Appl. No.: 304,889

[22] Filed: Sep. 13, 1994

[51] Int. Cl.[6] ..... B26B 17/00

[52] U.S. Cl. ..... 30/186; 30/337

[58] Field of Search ..... 30/178, 193, 229, 30/254, 260, 337, 186

[56] References Cited

U.S. PATENT DOCUMENTS

| | | | |
|---|---|---|---|
| D. 183,493 | 9/1958 | Piazza | D35/2 |
| 1,134,814 | 4/1915 | Black . | |
| 1,163,733 | 12/1915 | Bernard . | |
| 1,662,108 | 3/1928 | Fay . | |
| 2,903,790 | 9/1959 | Klein, Jr. | 30/254 |
| 3,324,549 | 6/1967 | Sharp | 30/181 |
| 3,772,783 | 11/1973 | Averitt | 30/186 |
| 4,079,513 | 3/1978 | Harrison | 30/193 |
| 4,394,796 | 7/1983 | Winer | 30/178 |
| 5,003,695 | 4/1991 | Lipscomb et al. | 30/193 |

*Primary Examiner*—Rinaldi I. Rada
*Assistant Examiner*—Jay A. Stelacone
*Attorney, Agent, or Firm*—Lerner, David, Littenberg, Krumholz & Mentlik

[57] ABSTRACT

A cutting tool for cutting an object flush against a surface from which it protrudes is disclosed. The cutting tool comprises a first jaw member which includes a blade having a cutting edge. A second jaw member is pivotally connected to the first jaw member and may include an anvil having a substantially planar surface with a first end substantially aligned with the cutting edge of the blade. The handle which may have first and second arms is connected to the first and second jaw members for facilitating relative movement of the cutting edge and the substantially planar surface between an open position at which the cutting edge is remote from the substantially planar surface and a closed position at which the cutting edge is adjacent to the first end of the substantially planar surface.

20 Claims, 8 Drawing Sheets

FLUSHCUTTER

FIELD OF THE INVENTION

The present invention relates to cutting tools. More particularly, the present invention relates to a cutting tool used to cut objects protruding from a surface in such a manner so that the object will be disposed flush with respect to the surface from which it protruded after the object has been cut.

BACKGROUND OF THE INVENTION

Cutting tools are widely used to perform many different functions. For example, cutting tools are used to cut hair, clothing, electrical wire, paper, flowers, tree branches, wood products, metal products, carpeting, food, etc.

In order to increase cutting performance, the cutting tool art has become highly specialized so that a different type of cutting tool may be used to best perform each of the aforementioned cutting operations. More particularly, a standard garden shears may be used to cut tree branches, prune plants or cut flowers. A scissor may be used for ordinary paper cutting operations while scissors having a more precision-type blade may be used to cut hair or clothing. High powered bolt cutters may be used to cut metal products while singled-edged utility knives may be used by contractors for various trimming operations.

Notwithstanding the wide variety of cutting tools that are available in the commercial marketplace, a need has existed for a cutting tool which can be used to cut shims flush against various object from which the shims initially protrude, such as doors, windows, kitchen cabinets, vanities, staircases, skylights, sheetrock walls, plaster walls, dishwashers, tub enclosures, shower stalls, filing cabinets, desks, refrigerators, counter tops, and the like. In this regard, a need has existed to cut shims flush against objects such as a window jamb or a door jamb after a window or door is installed and made level and plumb.

In a typical scenario, a window is installed into a frame, which may comprise a rectangular arrangement of two by fours. Tapered shims which may between nine inches and sixteen inches long and approximately one and a half inches wide are then placed between the window assembly and the frame so that the window can be made "true" (i.e., level and plumb). To accomplish this, the shims are generally placed in one or both of the bottom corners of the window assemblies. Shims are also usually placed between the sides of the window assembly and the frame to prevent warping or bowing of the window jamb over a period of time. After the shimming operation is completed, the window assembly may be tack-nailed by nailing through the window jamb into the shims and into the two by four frame. Since the window jamb is typically only about four and a half inches wide, the longer shims are left protruding therefrom. The shims then need to be cut flush with the window jamb so that a pleasing aesthetic final trim may be installed to cover the opening between the window jamb and sheetrock arranged adjacent to the window jamb.

Prior to the present invention, window installers performed such flush cutting by using a saw or utility knife. The saw would be used to cut the shims flush with the jamb. Similarly, a utility knife could be used to continuously score the shims at a location adjacent to the associated window jamb until the shim had been sufficiently weakened at which time it would be broken off along the score lines.

The aforementioned prior art methods of cutting shims flush with window jambs is not particularly desirable because it is time consuming and inefficient.

The present invention addresses the problem of obtaining flush cut shims with respect to associated window jambs by providing a new cutting tool which is adapted to quickly and accurately cut shims flush with an associated window jamb.

SUMMARY AND OBJECTS OF THE INVENTION

In accordance with one aspect of the present invention, a cutting tool is provided. The cutting tool comprises a first jaw member including a blade having a cutting edge, and a second jaw member pivotally connected to the first jaw member. The second jaw member includes a substantially planar surface which has a first end substantially in alignment with the cutting edge of the blade. The cutting tool also includes handle means connected to the first and second jaw members for facilitating relative movement of the cutting edge and the substantially planar surface between an open position at which the cutting edge is remote from the substantially planar surface and a closed position at which the cutting edge is adjacent the first end of the substantially planar surface whereby an object placed between the substantially planar surface and the cutting edge when the jaws are in their open position can be cut upon relative movement of the cutting edge and the substantially planar surface to the closed position so that the object may obtain a flush orientation with respect to an associated surface from which the object may have been protruding.

In a preferred embodiment, the blade of the cutting tool is a utility blade. It is also preferable for the substantially planar surface of the second jaw member to comprise at least part of an anvil.

The first jaw member preferably comprises mounting means for supporting the blade. Further, it is preferable for the cutting tool to comprise securing means for securing the blade on the mounting means.

It is preferable for the mounting means to comprise an upper groove and a lower groove which extend parallel to each other. The upper and lower grooves may be sized and shaped to receive a blade therebetween and are preferably associated with the securing means so that the blade is securely retained between the upper and lower grooves when in assembled position.

The securing means may comprise a set screw which extends into the mounting means so that the distance between the upper and lower grooves is selectively altered whereby the blade can be securely retained therebetween in assembled position, or can be selectively removed therefrom.

In a preferred embodiment, the cutting tool further comprises a slot arranged between the upper and lower grooves. The slot may extend parallel to the grooves so that an aperture of the mounting means, which includes a threaded receptacle, is arranged to extend perpendicular to and through the slot. In this preferred embodiment, the set screw may be arranged to extend through the aperture on one side of the slot and into the threaded receptacle at the other side of the slot so that adjustment of the relative positioning of the upper and lower grooves can be obtained.

It is desirable for the planar surface to be knurled so that an object to be cut can be securely retained between the first and second jaw means during cutting operation.

The handle means may comprise a first arm and a second arm which is movable toward and away from each other to obtain relative movement of the cutting edge and the anvil with respect to each other between the open and closed positions. Preferably, the first and second arms are pivotally connected to each other at a pivot point which corresponds with the pivot point arranged between the first and second jaw members. The first arm may be integrally attached to the first jaw member and the second arm may be integrally attached to the second jaw member. In one preferred embodiment, the first arm and the first jaw member extend collinearly along a single axis. It is also preferred for at least a portion of the second arm and the second jaw member to be offset from each other by an integral connection portion so that at least a portion of the second arm and the second jaw member extend substantially parallel to each other along first and second axes.

Accordingly, it is an object of the present invention to provide a cutting tool which can be used to cut shims flush with respect to associated objects such as doors, windows, kitchen cabinets, vanities, staircases, skylights, sheetrock walls, plaster walls, dishwashers, tub enclosures, shower stalls, filing cabinets, desks, refrigerators, counter tops, and the like, or other objects from which the shims may extend.

It is another object of the present invention to obtain such flush cutting of shims quickly and accurately.

It is a further object of the present invention to provide a cutting tool which is durable and which can be manufactured relatively inexpensively.

The above summary and objects, as well as further object, features and advantages of the present invention will be more fully understood when considered in view of the following detailed description of the present invention when taken in conjunction with the drawing which follow.

DETAILED DESCRIPTION OF A PREFERRED EMBODIMENT

In accordance with one preferred embodiment of the present invention, a cutting tool generally designated 10 is shown in FIGS. 1–8. The present cutting tool may be marketed under the trademark FLUSHCUTTER. It should be appreciated that although the cutting tool 10 will be described herein as a tool for cutting shims flush with an associated window jamb, it can also be used for many different applications in which a cooperating blade and anvil can be used to more efficiently cut an object. Further, the cutting tool 10 is particularly useful as a tool for use by tradesmen as well as do it yourselfers who desire to cut shims, or other objects, flush against a surface from which the shims or other objects initially extended.

Figure 1:
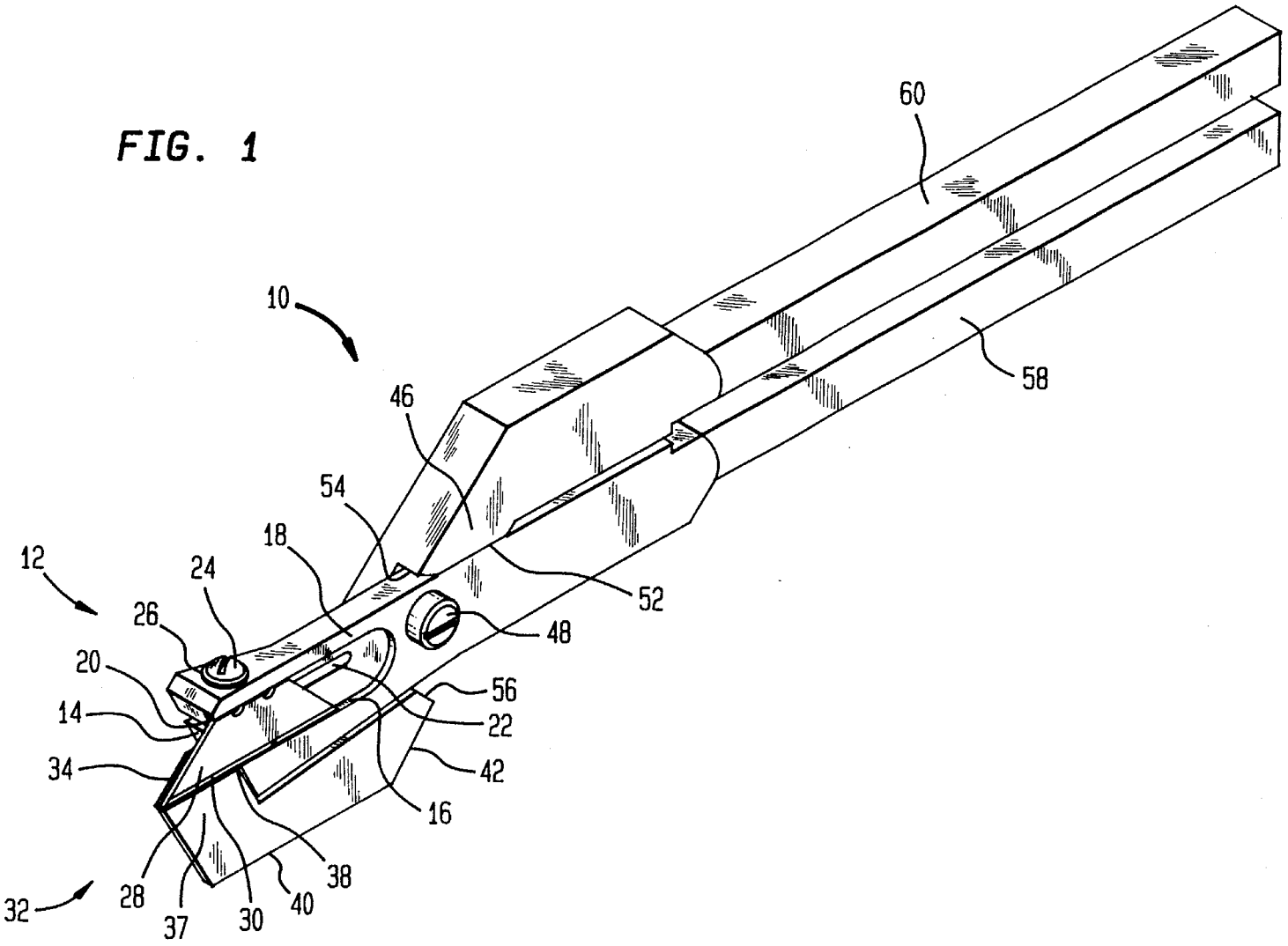
FIG. 1 is a left side perspective view of the cutting tool of the present invention with the jaws thereof in their closed position.
Figure 2:
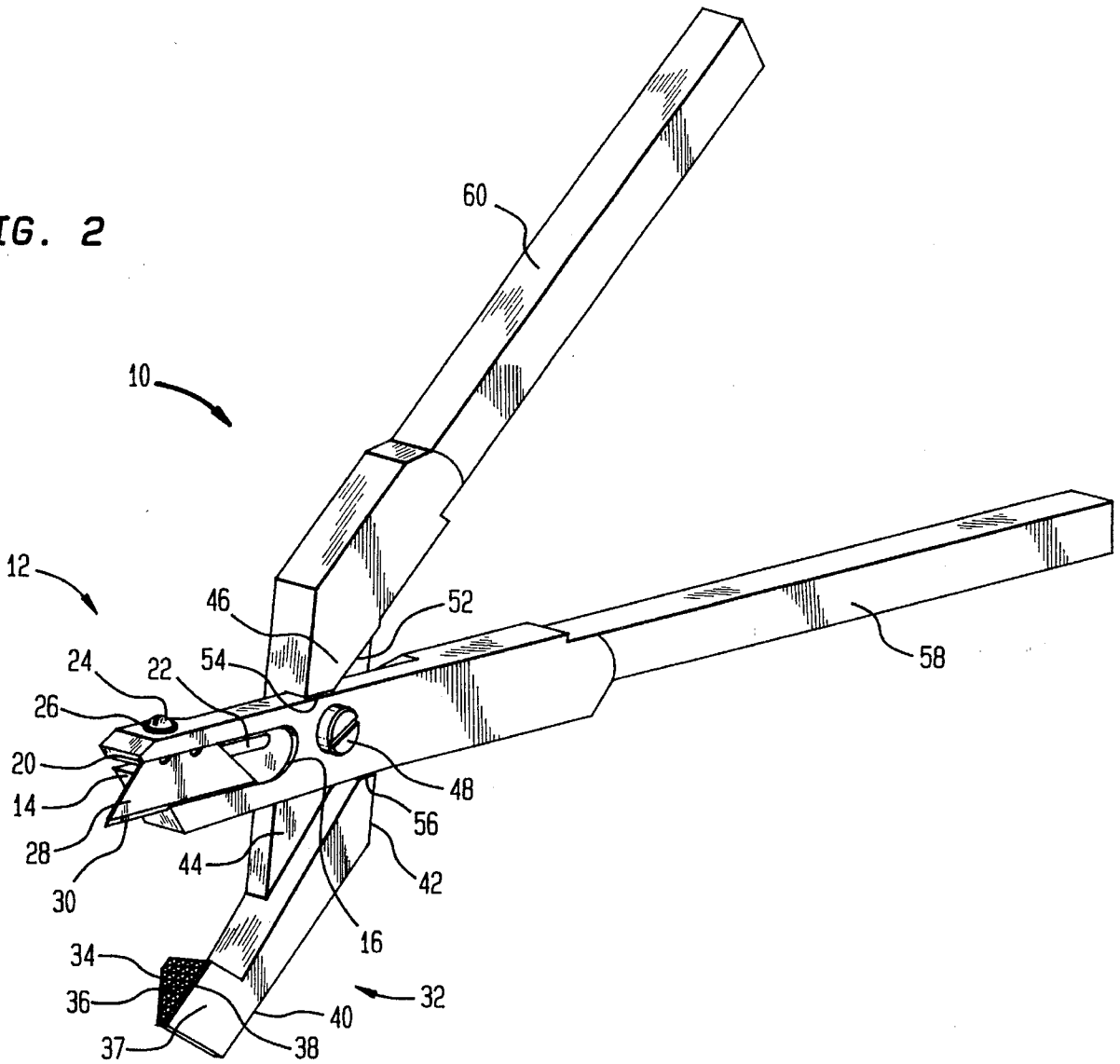
FIG. 2 is a left side perspective view of the cutting tool shown in FIG. 1 with the jaws thereof in their open position.

As shown in FIGS. 1 and 2, the cutting tool 10 includes a first jaw member generally designated 12, which is shown as an upper jaw member. Since the cutting tool 10 can be used in different orientations, the term first jaw member will be used herein for consistent reference.

The first jaw member 12 includes a bottom support surface 14 which has a groove 16 therein for supporting a cutting edge of an associated blade. The first jaw member 12 also includes a top support surface 18 and a top groove 20 extending parallel to the bottom groove 16. The top groove 20 is adapted to receive a top edge of an associated blade. Collectively, the bottom support surface 14 with the groove 16 therein and the top support surface 18 with the groove 20 therein serve as mounting means in which an associated blade, such as a utility blade 28 may be securely retained. The utility blade 28 includes a cutting edge 30 which extends partially within the bottom groove 16. Part of the cutting edge 30 extends outside of the groove 16 for performing the desired cutting operations while the top edge of the utility blade 28 is mounted within the groove 20 when the utility blade 28 is in assembled position.

As clearly shown in FIGS. 1–4, a slot 22 extends between the bottom and top grooves 16 and 20 and is arranged parallel thereto. The purpose of the slot 22 is to permit selective movement of the bottom and top groove 16 and 20 closer and further from each other so that the utility blade 28 can be selectively replaced or secured in assembled position. In this regard, if the cutting edge 30 of the blade 28 should become dull, the set screw 24 can be loosened as described above so that the blade 28 can slide out of its assembled position within the grooves 16 and 20. At that point, the blade 28 can be turned around so that the unused portion of the cutting edge 30 can be exposed, or a new blade can be inserted into the grooves 16 and 20 and thereafter be secured by the set screw 24 into assembled position. Although the preferred embodiment includes a removeable and replaceable blade as discussed above, alternate embodiments may include a permanent blade that can be sharpened as necessary.

Figure 6:
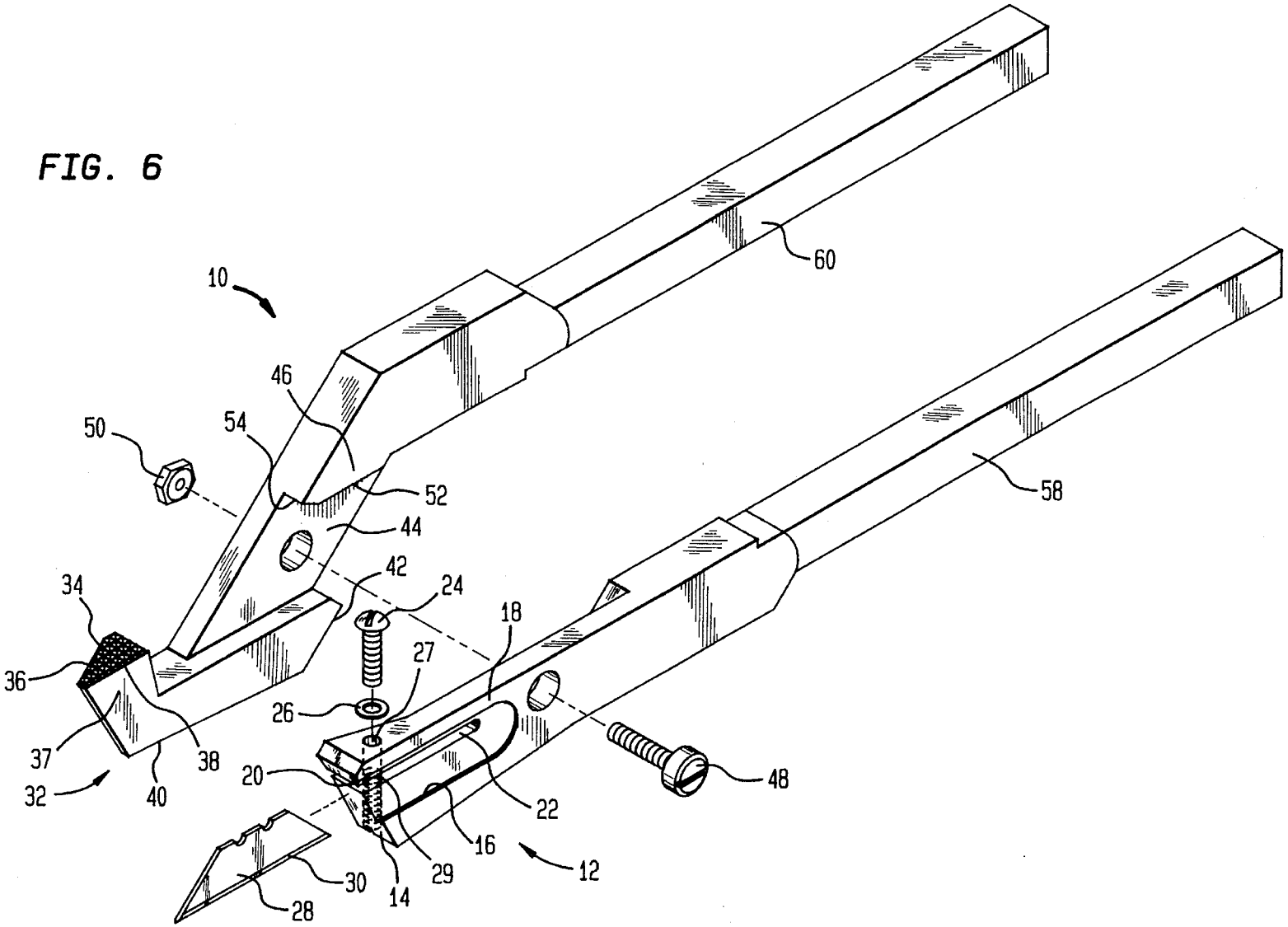
FIG. 6 is a perspective exploded view of the present invention.

A set screw 24 and a washer 26 is arranged adjacent to and on top of support surface 18. As shown in FIG. 6, the set screw 24 extends into the top support surface 18 and the bottom support surface 14 by extending through a top aperture 27 and on aligned threaded bottom aperture 29. As further shown in FIG. 6, the slot 22 is transversely arranged between the top aperture 27 and the bottom threaded aperture 29 so that the set screw 24 extends across the slot 22. As the set screw 24 is screwed into the threaded bottom aperture 29, it bears down on the top support surface 18 and exerts a force which pulls the bottom support surface 14 toward the top support surface 18. Thus, as the set screw 24 is tightened, the distance across the slot 22 is diminished. This permits the associated utility blade 28 to be securely retained within its assembled position in bottom groove 16 and top groove 20. When it is desired to replace the utility blade 28, the set screw 24 is backed out of the threaded bottom aperture 29 and the distance across the slot 22 is increased. Thus, the utility blade 28 can be removed from its assembled position within the bottom and top grooves 16 and 20 and a new utility blade can be inserted into assembled position.

As shown in FIGS. 1, 2 and 6, the first jaw member 12 has an outer surface (unnumbered) which preferably extends substantially coplanar with the utility blade 28 on at least on of the top and bottom support surfaces 18 and 14. The outer surface is described as being substantially coplanar with the utility blade 28 because the blade may be slightly recessed from the plane of the outer surface when it is in assembled position on the first jaw member 12. In a preferred embodiment of the present invention, the blade 28 is slightly recessed from the outer surface because it is arranged within spaced grooves 16 and 20.

The cutting tool 10 also includes a second jaw member generally designated 32 in FIGS. 1–8. The second jaw member 32 preferably comprises an anvil 34 having a substantially planar surface adapted to cooperate with cutting edge of the blade 28 as discussed further below. The substantially planar surface of the anvil 34 is preferably knurled as shown by reference numeral 36 to provide for improved gripping of an object to be cut when the object is placed between the anvil 34 and the cutting blade 30 prior to and during cutting operations. The anvil 34 includes an outer surface 37 which may extend perpendicular to the planar knurled surface. The anvil 34 also includes an outer edge 38 which is aligned with the cutting edge 30 of the associated blade 28. This feature of the present invention can best be appreciated with reference to FIGS. 1, 2 and 5. The second jaw member 32 also includes a bottom section 40 spaced from the substantially planar surface of the anvil 34.

As best appreciated when discussed in connection with the operation of the present cutting tool 10 below, the relationship between the outer edge 38 on the planar surface of the anvil 34 and the cutting edge 30 of the utility blade 28 is an important feature of the present invention as it permits the cutting tool 10 to cut a shim flush against a window jamb.

Preferably, the cutting tool 10 includes a first handle arm 58 which is connected to the first jaw member 12, and a second handle arm 60 which is connected to the second jaw member 32. In a particular preferred embodiment, the first handle arm 58 and the second handle arm 60 are integral with the respective first and second jaw members 12 and 32. In the preferred embodiment shown in FIGS. 1–8, the first handle arm 58 and the first jaw member 12 extend collinearly along a single axis. Unlike the collinear relationship between the first handle 58 and the first jaw member 12, the second handle 60 and the second jaw member 32 are integrally connected via a connecting portion having a top section 46 adjacent to handle portion 60, a bottom section 42 adjacent to the bottom side 40 of the second jaw member 32, and a central section 44 disposed between the top section 46 and the bottom section 42. As clearly shown in FIGS. 1–4, the connecting portion is integrally connected at an acute angle with respect to the handle 60 and the second jaw member 32.

The first jaw member 12 and the first handle 58 is pivotally connected to the second jaw member 32 and the second handle 60 at the central section 44 of the connecting portion which extends between the second jaw member 32 and the second handle 60. This feature of the present invention is shown in FIGS. 1–6.

Figure 3:
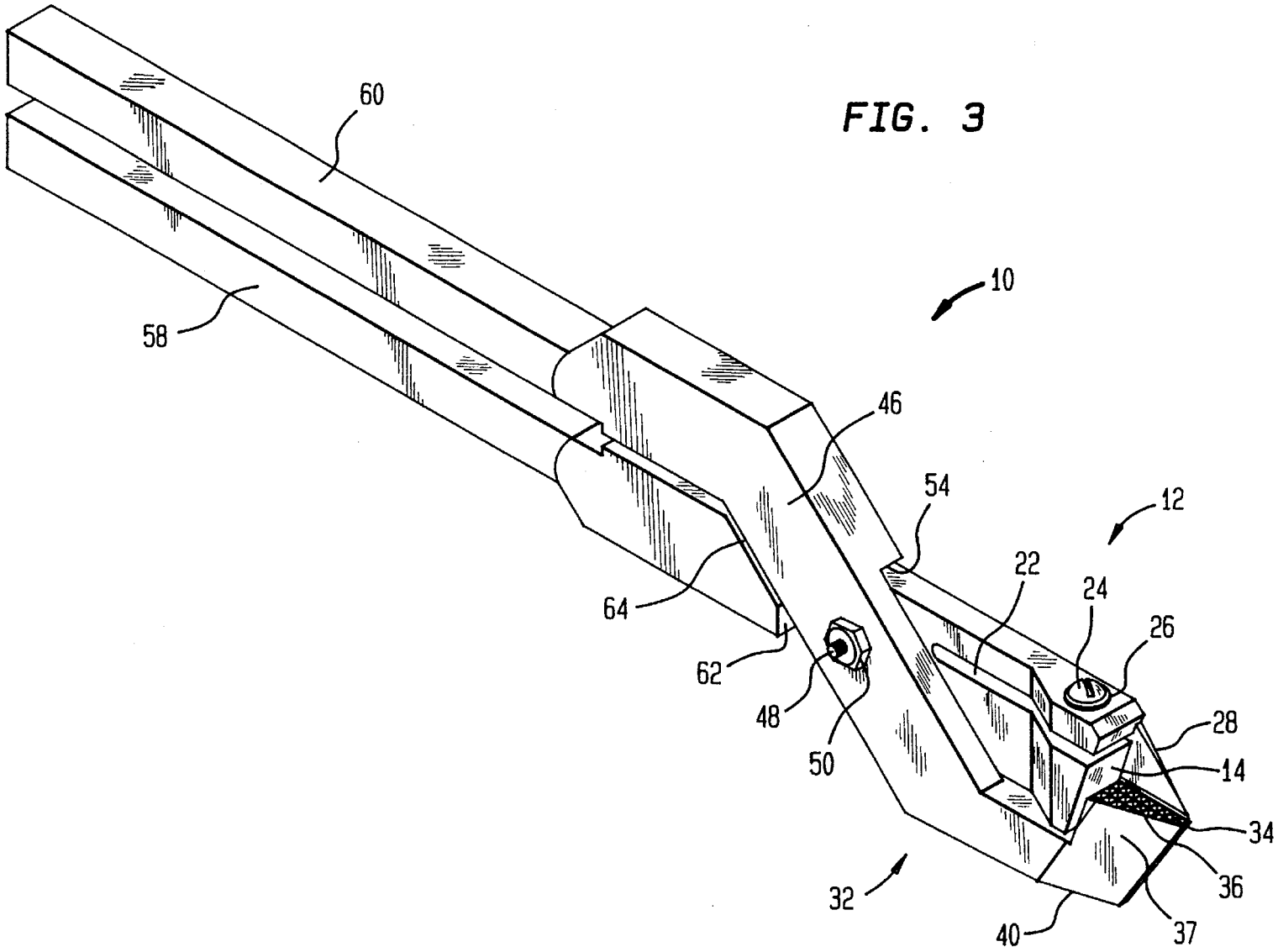
FIG. 3 is a right side perspective view of the cutting tool of the present invention with the jaws thereof in their closed position.
Figure 4:
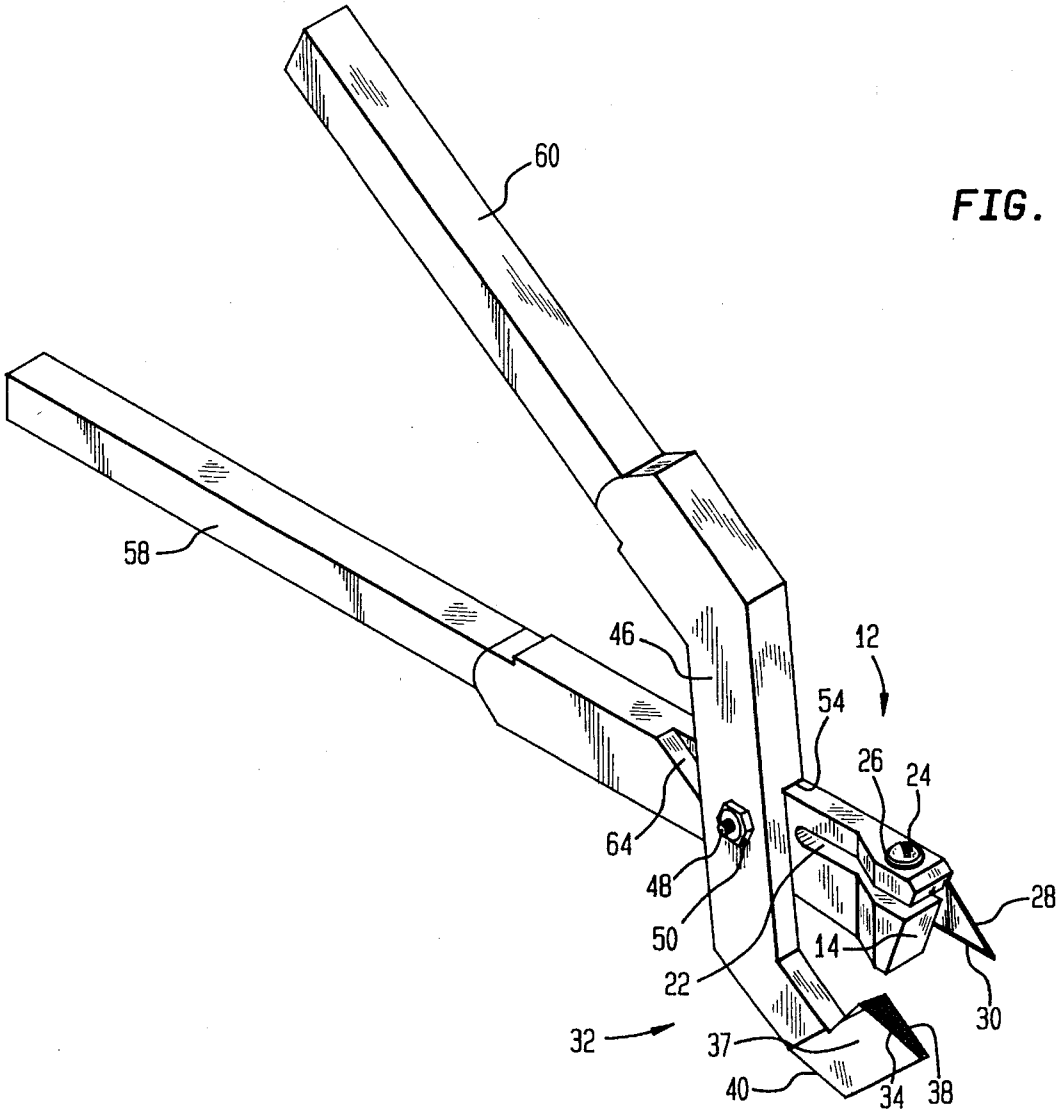
FIG. 4 is a right side perspective view of the cutting tool shown in FIG. 3 with the jaws thereof in their open position.
Figure 5:
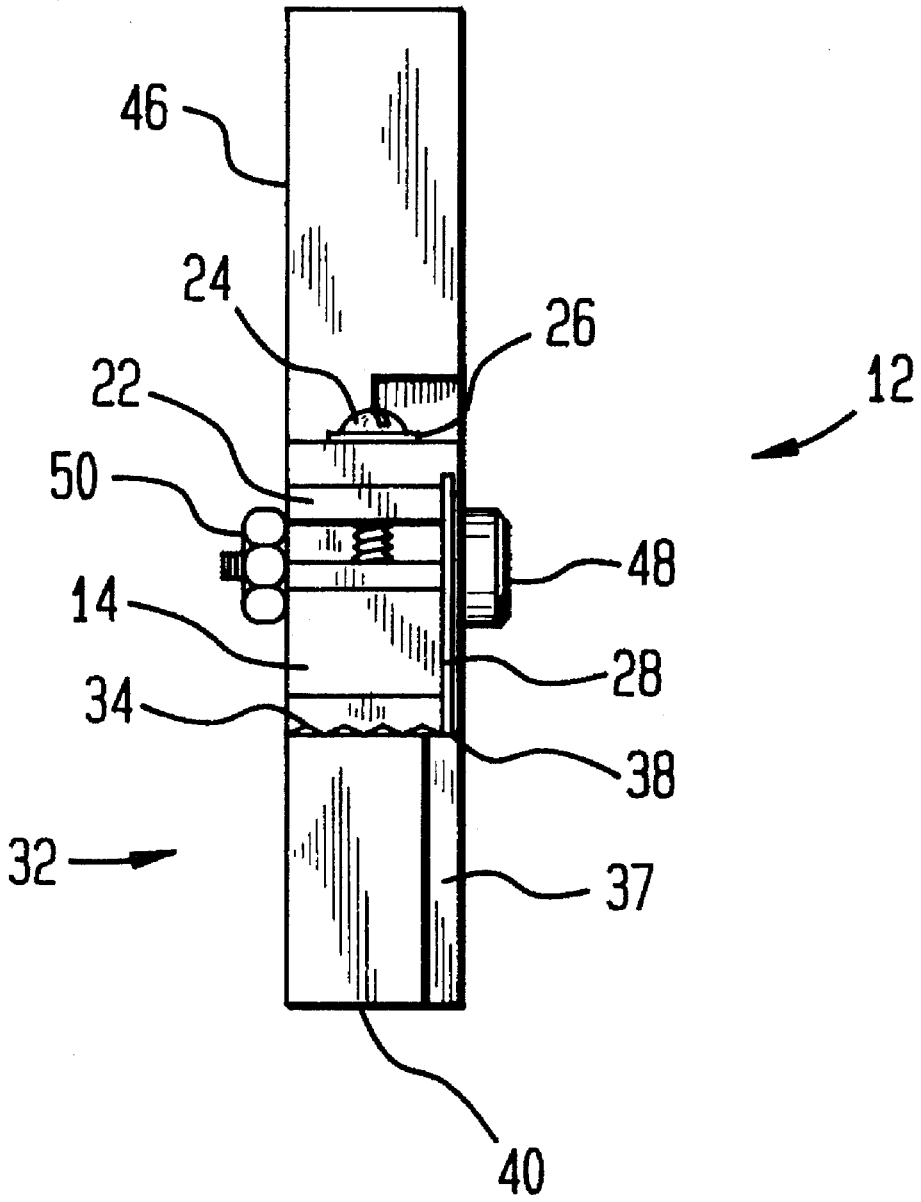
FIG. 5 is a front view of the cutting tool of the present invention.

A pivotal relationship between the first jaw member 12 and the second jaw member 32 is obtained by placing a screw 48 through aligned apertures which extend through an intermediate location between the first jaw member 12 and the first handle arm 58, and the second jaw member 32 and the second handle arm 60, respectively, as best shown in FIG. 6. The threaded screw 48 is secured to the cutting tool 10 by nut 50 as shown in FIGS. 3 and 4. The pivot location represented by the location of threaded screw 48, is selected to optimize the force which will be imparted to an object to be cut, such as a shim, when placed between cutting edge 30 of blade 28 and the knurled surface 36 of the anvil 34. More particularly, the selected pivot location of threaded screw 48 results in a shearing affect during cutting of the associated shims as the first jaw 12 and the second jaw 32 are moved from the open position to their closed position. The cutting action of the cutting tool 10 will be discussed further hereinbelow.

Various materials may be used to make the anvil 34. However, in preferred embodiments, the anvil 34 is made of a composite metal such as aluminum or brass. As is known, the blade 28 may be made of steel. It should be appreciated, however, that the blade 28 may also be made out of other suitable metals and other hard materials.

When the first jaw 12 and the second jaw 32 are arranged in a closed position as shown in FIGS. 1 and 3, a proximate portion of the first handle arm 58 is arranged adjacent to the lower flat surface 52 at the top region of connecting section 46. As evident from FIG. 3, when the first jaw member 12 and the second jaw member 32 are arranged in their closed position, an edge of the connecting portion between the second jaw 32 and the second handle 60 extends substantially parallel to a beveled edge 64 on a proximate portion of the first handle arm 58. Additionally, the first handle arm 58 and the second handle arm 60 extend substantially parallel to each other when the first and second jaws are in their closed position.

The cutting tool 10 includes various stopping sections adapted to prevent the first and second jaw members from getting past a preselected fully opened position. In this regard, when the first and second jaw members are arranged in their fully opened position, as shown in FIGS. 2 and 4, the first handle arm 58 and the second handle arm 60 extend at an acute angle with respect to each other. In a preferred embodiment, the first handle arm 58 and the second handle arm 60 include the aforementioned various stopping portions which prevent the first jaw member 12 and the second jaw member 32 from moving beyond the position shown in FIGS. 2 and 4. In particular, beveled stopping portions 54 and 56 arranged on the central area 44 of the connecting portion between the second handle arm 60 and the second jaw member 32 are adapted to abut the second handle arm 58, respectively, at the top and bottom sides in the area marked by threaded screw 48. A further stopping feature is illustrated in FIG. 4 as edge member 62 and the proximate portion of the first handle arm 58 abuts a preselected position on the connecting portion between the second handle arm 60 and the second jaw member 32.

Figure 7:
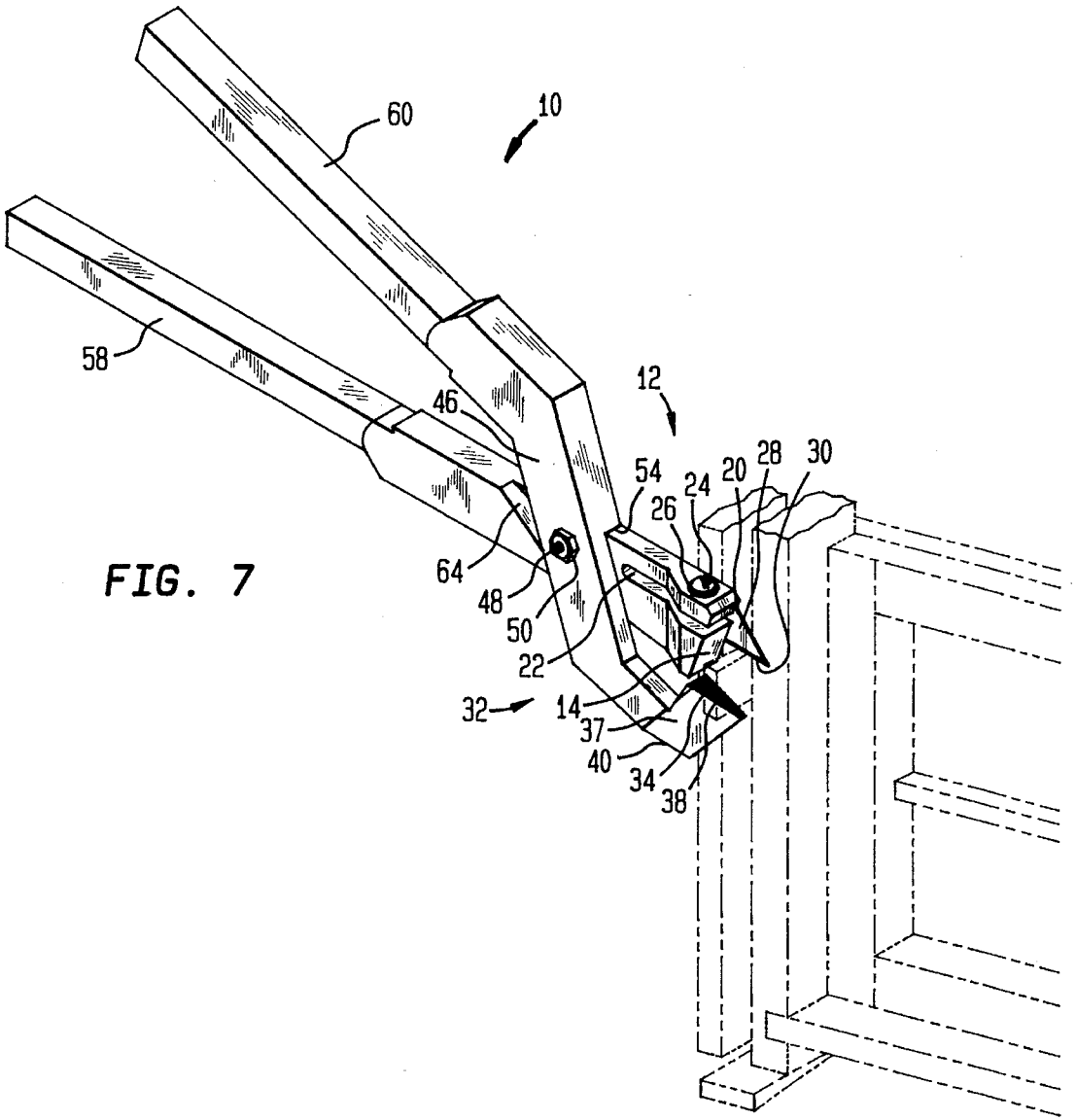
FIG. 7 is a perspective view of the cutting tool of the present invention prior to cutting a shim flush with respect to an associated window jamb.
Figure 8:
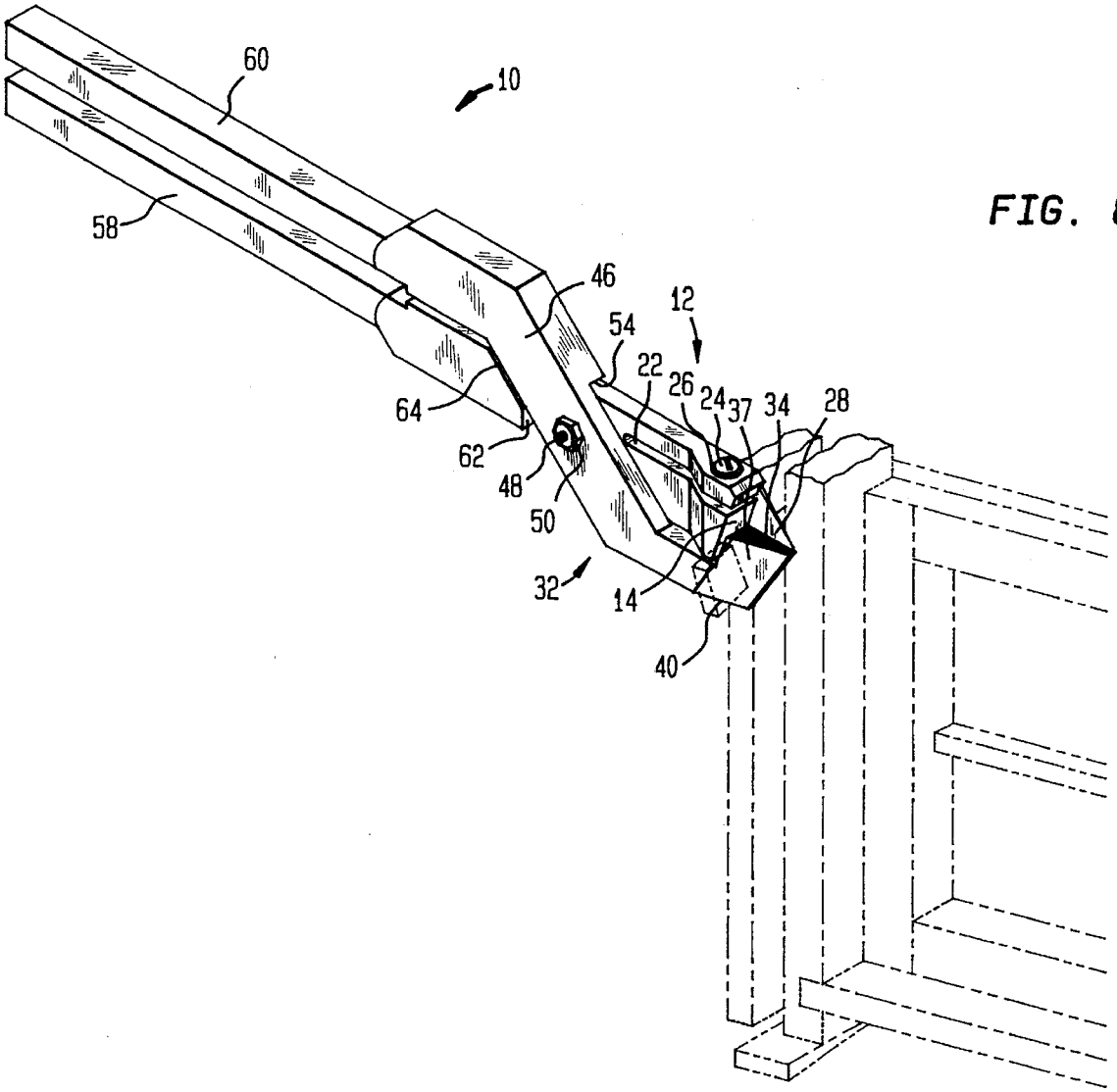
FIG. 8 is a perspective view of the cutting tool of the present invention shown in FIG. 7 immediately after an associated shim has been cut flush against the window jamb.

In operation, the cutting tool 10 may be used to cut shims flush against a window jamb after the shims have been placed in their proper position so that a window assembly is level and plumb in a window frame. The shims are typically made of a relatively soft wood. However, shims made of other materials such as hard woods, plastic, and the like can also be cut with the present invention. FIGS. 7 and 8 illustrate how the cutting tool 10 can be used to cut shims flush against a window jamb.

In particular, FIG. 7 illustrates a shim protruding from a window jamb and placed between the knurled planar surface 36 of the anvil 34 and the cutting edge 30 of the blade 28. A generally flat outer surface 37 of the anvil 34, which extends perpendicular to the knurled planar surface 36, is placed flush against the window jamb to provide a reference location so that a flush cut of the protruding shim can be obtained. Since the cutting edge 30 of the blade 28 is aligned substantially with the outer edge 38 of the anvil 34, no further alignment is necessary in order to obtain the desired flush cut.

FIG. 8 illustrates a shim immediately after it has been cut flush against a window jamb by using the cutting tool 10 of the present invention. This is accomplished by moving the first handle arm 58 and the second handle arm 60 toward each other so that the cutting edge 30 of the blade 28 and the knurled surface 36 of the anvil 34 are moved to their closed position. As this movement takes place, sufficient force is exerted on the shim by the cooperating blade 28 and anvil 34 to cleanly slice through the shim whereby the shim is cut flush against the window jamb.

The use of the present cutting tool 10 overcomes the problems associated with prior art methods of cutting shims flush against window jambs in that it saves a large amount of time and permits the shims to be accurately cut flush against a window jamb with a minimal amount of skill. As discussed above, it should be appreciated that the cutting tool 10 can be used for many applications other than cutting shims flush against window jambs. In particular, it is also useful to cut shims and other objects flush against doors, kitchen cabinets, vanities, staircases, skylights, sheetrock walls, plaster walls, dishwashers, tub enclosures, shower stalls, filing cabinets, desks, refrigerators, counter tops, and the like.

While the foregoing description and figures are directed toward preferred embodiments in accordance with the present invention, it should be appreciated that numerous modifications can be made to each of the components of the cutting tool 10. Indeed, such modifications are encouraged to be made in the materials, structure and arrangement of the preferred embodiments of the present invention without departing from the spirit and scope of the same. Thus, the foregoing description of the preferred embodiment should be taken by way of illustration rather than by way of limitation with respect to the present invention, which is defined by the claims set forth below.

I claim:

1. A cutting tool comprising:

a first jaw member including a blade having a cutting edge and an outer surface extending substantially coplanar to said blade; a second jaw member pivotally connected to said first jaw member and including a substantially planar surface having an outer edge substantially aligned with said cutting edge of said blade, said second jaw member further including an outer surface extending substantially perpendicular to said substantially planar surface; and handle means connected to said first and second jaw members for facilitating relative movement of said cutting edge and said substantially planar surface between an open position at which said cutting edge is remote from said substantially planar surface and a closed position at which said cutting edge overlies said substantially planar surface and is at least substantially adjacent said outer surface of said first jaw member and said outer edge of said substantially planar surface, said cutting edge and said outer edge of said substantially planar surface of said second jaw member and said outer surface of said second jaw member being constructed and arranged in a substantially flush configuration whereby an object placed between said substantially planar surface and said cutting edge when in said open position can be cut upon relative movement of said cutting edge and said substantially planar surface to said closed position so that the object may obtain a flush orientation with respect to an associated surface from which the object may have been protruding.

2. The cutting tool of claim 1 wherein said blade is a utility blade.

3. The cutting tool of claim 1 wherein said second jaw member comprises an anvil, said substantially planar surface being part of said anvil.

4. The cutting tool of claim 1 wherein said first jaw member comprises mounting means for supporting said blade, said cutting tool further comprising securing means for securing said blade on said mounting means.

5. The cutting tool of claim 4 wherein said securing means is adapted to permit selected removal and replacement of said blade with respect to said mounting means.

6. The cutting tool of claim 4 wherein said mounting means comprises an upper groove and a lower groove extending parallel to each other, said upper and lower grooves being sized and shaped to receive a blade therebetween and being associated with said securing means so that the blade is securely retained between said upper and lower grooves when in assembled position.

7. The cutting tool of claim 6 wherein said securing means comprises a set screw arranged above said mounting means and extending into said mounting means so that said upper and lower grooves are selectively moved closer to and further from each other whereby said blade can be securely retained therebetween in assembled position or can be selectively removed therefrom.

8. The cutting tool of claim 7 wherein said mounting means further comprises a slot arranged between said upper and lower grooves and extending parallel thereto, said mounting means further comprising an aperture including a threaded receptacle having an axis extending through said slot and being perpendicular thereto, said set screw being arranged to extend through said aperture at one side of said slot and into said threaded receptacle at the other side of said slot so that adjustment of the relative positioning of said upper and lower grooves can be obtained.

9. The cutting tool of claim 1 wherein said substantially planar surface is knurled so that an object can be securely retained between said first and second jaw means during cutting operations.

10. A cutting tool comprising:

a first jaw member including a blade having a cutting edge and an outer surface extending substantially coplanar to said blade; a second jaw member including an anvil pivotally connected to said first jaw member, said anvil having a substantially planar surface and an outer edge defining a straight edge substantially aligned with said cutting edge of said blade, said second jaw member further including an outer surface extending substantially perpendicular to said substantially planar surface; and a handle comprising a first arm fixed to said first jaw member and a second arm fixed to said second jaw member, said first and second arms being moveable toward and away from each other to facilitate relative movement of said cutting edge and said anvil with respect to each other between an open position at which said cutting edge is remote from said anvil and a closed position at which said cutting edge overlies said anvil and is at least substantially adjacent to said outer edge, of said substantially planar surface of said anvil, said first and second arms being pivotally connected to each other at the same location of the pivotal connection between said first and second jaw members, said cutting edge and said outer surface of said first jaw member and said outer edge of said anvil of said second jaw member and said outer surface of said second jaw member being constructed and arranged in a substantially flush configuration whereby an object placed between said anvil and said cutting edge when in said open position can be cut upon relative movement of said cutting edge and said substantially planar surface of said anvil to a closed position so that the object may obtain a flush orientation with respect to an associated surface from which the object may have been protruding.

11. The cutting tool of claim 10 wherein said blade is a utility blade.

12. The cutting tool of claim 10 wherein said first jaw member comprises mounting means for supporting said blade, said cutting tool further comprising securing means for securing said blade on said mounting means.

13. The cutting tool of claim 12 wherein said securing means is adapted to permit selective removal and replacement of said blade secured on said mounting means.

14. The cutting tool of claim 13 wherein said mounting means comprises an upper groove and a lower groove extending parallel to each other, said upper and lower grooves being sized and shaped to receive a blade therebetween and being associated with said securing means so that said blade is securely retained between said upper and lower grooves when in assembled position.

15. The cutting tool of claim 14 wherein said securing means comprises a set screw arranged above said mounting means and extending into said mounting means so that said upper and lower grooves are selectively moved closer to and further from each other whereby said blade can be securely retained therebetween in assembled position or can be selectively removed therefrom.

16. The cutting tool of claim 15 wherein said mounting means further comprises a slot arranged between said upper and lower grooves and extending parallel thereto, said mounting means further comprising an aperture including a threaded receptacle having an axis extending through said slot and being perpendicular thereto, said set screw being arranged to extend through said aperture at one side of said slot and into said threaded receptacle at the other side of said slot so that adjustment of the relative positioning of said upper and lower grooves can be obtained.

17. The cutting tool of claim 10 wherein said first arm is integrally attached to said first jaw member and said second arm is integrally attached to said second jaw member.

18. The cutting tool of claim 17 wherein said first arm and said first jaw member extend collinearly along a single axis.

19. The cutting tool of claim 18 wherein at least a portion of said second arm and said second jaw member are offset from each other by an integral connecting portion so that at least a portion of said second arm and said second jaw member extend substantially parallel to each other along first and second axes, said collinear first arm and first jaw member having a top side and a bottom side, said second arm and second jaw member being arranged on both said top and bottom sides of said first arm and said first jaw member.

20. The cutting tool of claim 10 wherein said anvil includes a knurled substantially planar surface so that the object to be cut can be securely retained between said anvil and said cutting edge of said blade during cutting operations.

* * * * *

UNITED STATES PATENT AND TRADEMARK OFFICE

CERTIFICATE OF CORRECTION

PATENT NO. : 5,507,096

DATED : April 16, 1996

INVENTOR(S) : Gamba

It is certified that error appears in the above-identified patent and that said Letters Patent is hereby corrected as shown below:

Column 7, lines 62-63, delete "said outer surface of said first jaw member and".
Column 7, line 64, delete "surface," and insert --surface;-- therefore.
Column 7, line 64, after "said cutting edge and" insert --said outer surface of said first jaw member and--.
Column 8, delete "said outer edge," and insert --said outer edge--.

Signed and Sealed this

Ninth Day of July, 1996

Bruce Lehman

*Attest:*

BRUCE LEHMAN

*Attesting Officer*

*Commissioner of Patents and Trademarks*